US006190504B1

(12) United States Patent
Karlsson et al.

(10) Patent No.: US 6,190,504 B1
(45) Date of Patent: Feb. 20, 2001

(54) METHOD AND ARRANGEMENT FOR CIRCULATING WATER IN A PAPER MACHINE

(75) Inventors: Markku Karlsson, Parainen; Antti Suonperä , Jyväskylä ; Rainer Gartz, Kotka; Sakari Kaijaluoto, Jyväskylä, all of (FI)

(73) Assignee: Valmet Corporation (FI)

( * ) Notice: Under 35 U.S.C. 154(b), the term of this patent shall be extended for 0 days.

(21) Appl. No.: 08/862,689

(22) Filed: May 23, 1997

(30) Foreign Application Priority Data

May 23, 1996 (FI) ..... 962176

(51) Int. Cl.[7] ..... D21F 1/66

(52) U.S. Cl. ..... 162/190; 162/DIG. 8; 210/710; 210/928

(58) Field of Search ..... 162/189, 190, 162/DIG. 8; 210/134, 195.2, 652, 710, 928

(56) References Cited

U.S. PATENT DOCUMENTS

| | | | | |
|---|---|---|---|---|
| 5,196,090 | | 3/1993 | Corbellii et al. | 162/190 |
| 5,302,246 | * | 4/1994 | Nykanen et al. | 162/29 |
| 5,558,782 | | 9/1996 | Bleakley et al. | 210/712 |

FOREIGN PATENT DOCUMENTS

| | | |
|---|---|---|
| 281974 | 4/1975 | (FI) . |
| 913189 | 7/1991 | (FI) . |
| 943895 | 2/1995 | (FI) . |
| 945830 | 6/1995 | (FI) . |
| 1482002 | 8/1977 | (GB) . |
| 2281319 | 3/1995 | (GB) . |

OTHER PUBLICATIONS

K.–H. Beuermann "Faserrückgewinnungsanlangen—Bauarten und Funktionsvergleiche", pp. 575–577, J.M. Voith GmbH, Nov. 24, 1977.

* cited by examiner

*Primary Examiner*—Dean T. Nguyen
(74) *Attorney, Agent, or Firm*—Steinberg & Raskin, P.C.

(57) ABSTRACT

A method in a paper machine for arrangement of water circulation therefor and arrangement of a water circulation system in a paper machine. In view of full or partial closing of the water circulations in a paper machine, the wash water flows from the fabrics and from other devices in the paper machine as well as the water drained from the paper web to be produced are recovered selectively based on the place of origin thereof in the paper machine. At least a part of the recovered different water flows are cleaned, and the cleaned water flows are recirculated to applications of reuse suitable in view of their washing potential in the papermaking process.

17 Claims, 7 Drawing Sheets

METHOD AND ARRANGEMENT FOR CIRCULATING WATER IN A PAPER MACHINE

FIELD OF THE INVENTION

The present invention relates to a method in a paper machine for arranging its water circulation and an arrangement for the water circulation in the paper machine.

BACKGROUND OF THE INVENTION

Paper and board grades are produced in a paper machine by draining water out of a mixture of water and wood fibers prepared in a stock preparation plant and by using constantly moving fabrics in the different principal parts of the paper machine, which parts are typically called the wire part, the press section, and the dryer section. The fabrics in a paper machine are usually permeable members which form a closed loop, i.e., are endless, and which are made of a plastic and/or a metal material and/or which are felts consisting of natural and/or synthetic fibers. The fabric loops are rotated constantly by means of drive rolls or some other comparable equipment. During the draining of water from the mixture, the fabrics are contaminated by materials which come from the paper web and from the different process waters. In order that the fabrics and the elements in the paper machine, such as rolls, doctors, forming ribs, suction boxes, etc., may operate satisfactorily, they must be washed constantly or at least periodically by means of water jets, and the resultant wash water must be removed. The wash water from the fabrics is contaminated, but it can, however, be used as circulation water in the paper machine.

In present-day paper mills, an abundance of fresh water is needed for cooling and, after that, among other things, for the above washing requirements in the wire part and in the press section and for dilution in the stock preparation plant. After the wire part and the press section, these waters are passed mainly to mix with the fibrous circulation waters. Any excess amount of circulation water is disposed of as waste water. The net amount of fresh water that is needed for the washing jets in a paper machine is of an order of about 10 cubic meters per ton of paper produced. Thus, from a paper mill, an abundance of warm waste water is obtained, which must be cleaned, for example biologically, and, if necessary, cooled before the cleaning.

As known in the prior art, the wash jet waters in a paper machine are collected by means of various basins and troughs and passed into the circulation water system. Besides fresh water, circulation water of the paper machine is also employed as the jet water in the wire part and the press section. The circulation water is usually cleaned by means of filters having screens whose measure is about 150$\mu$ (corresponding to about 100 mesh). Such a screen measure, however, permits the passage of fine particles and dissolved material. A clear filtrate obtained from such a filtering device still contains finer particles and dissolved material. These impurities may cause blocking of jet nozzles and their structures and contamination of these devices and other equipment out of the disturbing materials in the water system in a paper machine, which results in negative effects in the quality and production of paper. The use of such water as an additional substitute for fresh water would risk damage to the efficient operation of the equipment and the production of paper. Therefore, for more demanding washing of the fabrics and parts of a paper machine, fresh water is used, which is often chemically cleaned prior to actual use in the paper machine.

Fresh water is generally cold, and it must be heated to a considerable extent, often to the operating temperature that is required in the papermaking process. The temperature of new, fresh cold water must be raised, for example, from about 7° C. to about 50° C., and usually it is treated chemically in order to remove humus materials and provide a proper color, in compliance with the quality requirements of the paper machine, and its use involves high processing costs. The high cost of cleaning of fresh water and waste water arises from the fact that an abundance of fresh water must be introduced into the process constantly. Fresh water which is used in the jets in a paper machine and which has been treated chemically also increases the concentrations of inorganic materials in the system.

OBJECTS AND SUMMARY OF THE INVENTION

It is an important object of the present invention to lower the consumption of fresh water in a paper machine.

More specifically, it is an object of the present invention to improve the papermaking process from the point of view of decreasing the burden on the environment (in the form of less water products) and the requirement of fresh water (in the form of lowering the amount of fresh water needed). In particular, the object is optimal cleaning of the various contaminated waters present in a paper machine by interconnecting different cleaning devices in a novel manner and by using cleaned waters and the concentrates coming from the cleaning devices in an optimal manner in consideration of their degree of purity and their washing potential.

Another object of the present invention is to provide novel overall solutions of technology, which solutions, at the same time as they reduce the burden on the environment in the form of lower consumption of fresh water and lower quantities of waste water, also provide economies of energy and reduce the consumption of chemicals in the different parts in a paper mill.

In order to achieve these objects and others, in accordance with the invention, in view of full or partial closing of the water circulations in a paper machine, the wash waters from the fabrics and from other devices in the paper machine as well as the waters drained from the paper web to be produced are recovered selectively based on the place of origin of the waters, and at least a part of the recovered different waters are cleaned, and the cleaned waters are recirculated to applications of reuse suitable in view of their washing potential in the papermaking process.

It has been estimated that the cleaning and evaporation of process waters optimally in a plant integrated in accordance with the present invention considerably lowers the burden to the environment, in the form of a reduction in waste water and a lower requirement of fresh water, and is more advantageous compared with the unlimited and abundant use of fresh water with the resulting high requirement of cleaning in most present-day paper mills.

The trough waters from the wash jets in a paper machine are, on the average, cleaner than the waters of the short cycle in a paper machine. In the prior art, all of these wash waters are mixed with fibrous circulation waters after their use, but in a preferred embodiment of the present invention the semi-clean fabric conditioning water coming from the formers and presses is cleaned and used in a novel manner. The waters that clean the wires and felts have not been contaminated to the level of contamination of wire water, so that these waters still have a washing potential etc., potential of use, which are utilized in the present invention. In the present invention, this washing potential still possessed by the relatively clean waters is utilized. Moreover, in the present invention, the waters that are collected selectively in accordance with the place of origin can also be cleaned more readily.

In respect of the waste waters, in the present invention a so-called sorting based on the place of origin is applied. For example, water from conditioning of fabrics in a paper machine can be collected and taken for useful use. In this manner, the use of chemically pure fresh water can be reduced. It is an advantage of the invention that chemically purified fresh water is not needed in equally large quantities as in prior art systems for jet water in a paper machine. For example, the jet waters can be cleaned by means of cleaning systems of their own so that a paper machine is obtained which requires a smaller amount of fresh water.

In one preferred embodiment of the invention, the water flows recovered by means of selective collecting of wash waters can be cleaned within the limits that are set by the washing potential either by cleaning the waters that were collected selectively or even by using these water flows without cleaning.

Disturbing materials (impurities and contaminants) arrive along with the stock, and the papermaking process produces more such materials. These disturbing materials must be removed from the water and taken out of the water circulation system. In the selective water collecting method in accordance with one preferred embodiment of the invention, the water departing from a paper machine is divided into at least two parts, of which one part is cleaner than the other. In such a case, the short cycle in the paper machine can be operated less clean than in the prior art. Paper mills in accordance with the present invention have a possibility to choose the amount of fresh water that is used. In the present invention, the levels of disturbing materials in a paper machine depend on how large a proportion of the waters in fresh water jets is replaced and on the sort of the replacement water used.

In the present invention, there is a novel process arrangement for selective collecting of jet waters, which jet waters are used for cleaning of elements and fabrics, and the collected mixture is cleaned for different sorts of reuse in the production of pulp and paper by using novel combinations of the following separation technologies:

1) Flotation followed by microfiltration in an area in which the pore size of the filtering medium is, for example, from about 50$\mu$ to about 10$\mu$. This cleaning combination can be used alone or as a pre-processing stage for subsequent stage employing various separation technologies. The separated solid matter can be passed to reuse in the production of pulp and paper, or it can be passed to waste water treatment.
2) Membrane technology in the levels of ultrafiltration osmosis, nanofiltration osmosis or inverse osmosis. The concentrate from the membrane separation can pass to various reuses in the production of pulp and paper or to evaporation in the processing of waste water.
3) Evaporation technology by means of vacuum and/or compressor evaporation systems. The steam in the vacuum evaporation can be low-pressure steam from the power plant or recovered waste heat from the manufacture of paper or mechanical pulp. To the evaporation system, at the same time, various other waters can be fed from the production of paper and pulp.

After the jet water has done its job, it can be collected selectively by means of novel constructions and arrangements in the process and be passed into the cleaning system, which consists of any one of the various combinations of separation technologies mentioned above. Since selectively collected water contains a smaller amount of solid matter and dissolved organic and inorganic material than the more contaminated circulation water of a paper machine, the water can be cleaned more easily and readily and with a higher capacity directly after the washing duty than if it were fully mixed with the circulation water in the paper machine. The cleaned water can be passed to the jets or different other uses of a paper machine having a better quality than the circulation waters. The method of the invention does not result in the prior art problems mentioned above, in which circulation waters of the paper machine are used as jet waters, e.g., damage to the equipment. A higher proportion of the jets can be connected to the cleaned waters obtained from the stages employing separation technologies and from combinations of such stages. Thus, the amount of fresh water needed in the paper machine is reduced.

The flotation filtrate may be cleaned by means of microfiltration. Since the flotation removes most of the solid matter, the flow resistance for microfiltration is lowered to such an extent that the pore size in the filtering medium can be as small as 10$\mu$ and, nevertheless, a satisfactory hydraulic capacity is achieved.

The arrangement for circulating water in a paper machine in accordance with the invention comprises first means for recovering separate flows of wash water from fabrics and other devices in the paper machine, each flows originating from a different location in the paper machine, second means for recovering water drained from a paper web to be produced in the paper machine, the second recovering means being separate from the first recovering means, cleaning means for cleaning flows of at least some of the recovered water to produce a clean water flow, and recirculating means for recirculating the clean water flow to applications of reuse in the paper machine suitable in view of their washing potential in the papermaking process. The first recovering means may be arranged to recover separate flows of water used for conditioning the fabrics, water used for washing devices in the paper machine, water used for lubricating components in the paper machine, and water used for sealing components in the paper machine. The cleaning means may comprise a flotation cleaning stage and a microfiltration cleaning stage for separating suspended solid matter and colloids, and an optional membrane separation stage. If the cleaned water flows are the fabric conditioning water and the washing device flows, and the paper machine includes a first set of water jets which operate on circulation water and a second set of water jets which operate on water cleaner than the circulation water, the recirculating means may include first passage means for directing a first part of the clean water flow from the flotation/microfiltration stages to the first set of water jets, and second passage means for directing a second part of the clean water flow into and through the membrane separation stage for further cleaning and at least a part of the products from the membrane separation stage to the second set of water jets.

BRIEF DESCRIPTION OF THE DRAWINGS

Additional objects of the invention will be apparent from the following description of the preferred embodiment thereof taken in conjunction with the accompanying non-limiting drawings, in which.

DETAILED DESCRIPTION OF THE PREFERRED EMBODIMENTS

Figure 1:
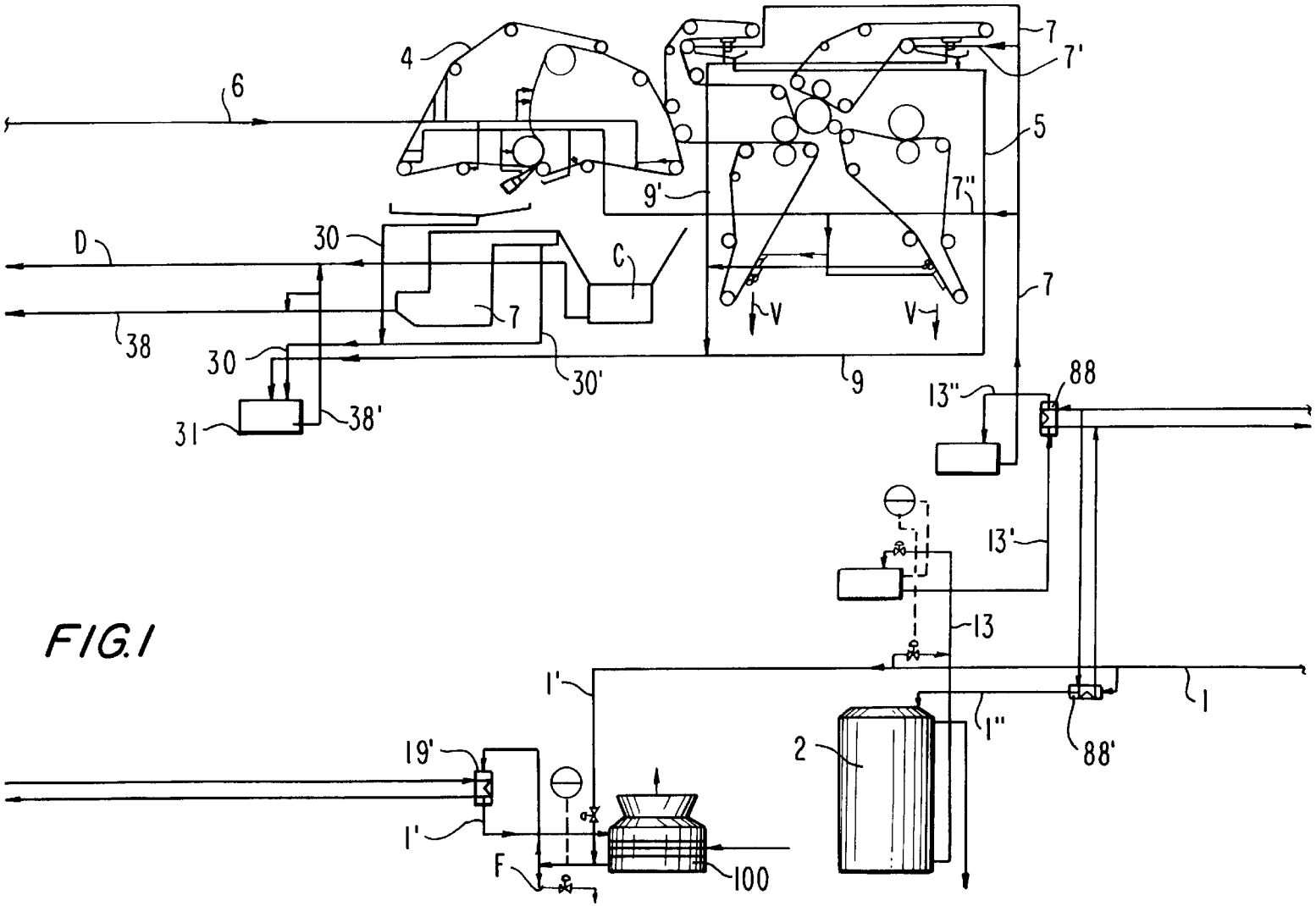
FIG. 1 shows a prior art paper machine.

Referring to FIGS. 1–7 wherein like reference numerals refer to the same or similar elements, in the prior art paper machine construction shown in FIG. 1, the jet water that is used is mainly fresh water which is passed to the paper machine along ducts 1,1',1",13,13',13". Jet water is needed both in a wire part 4 of the paper machine, to which it is passed along a duct 7", and in a press section 5 of the paper machine, to which it is passed along ducts 7,7'. Fresh water is heated to the required temperature by means of heat exchangers 88,88' and initially passed into a warm fresh water tank 2 along the duct 1".

In the prior art, a certain amount of cold fresh water is also used as make-up water for a cooling tower 100. This water is passed along the duct 1' to the water circulation system of the cooling tower. Water to be cooled in the cooling tower 100 is lost in the form of humid air, and some water passes then into a sewer along a duct F.

The circulation water flows from the press section 5 are passed into a circulation water tank 31 along ducts 9,9'. The wash water flows and the conditioning water flows pass into sewers V. Wash and circulation water flows enter into the circulation water tank 31 along ducts 30,30' also directly from the wire part 4. Circulation water flows from the wire part 4 are also passed into a wire pit 7, from which they are passed into the circulation water tank 31 along the duct 30' and as circulation water along a duct 38. Stock broke is passed through a couch chest C into the broke system along a duct D. The water from the circulation water tank 31 is passed along a duct 38' as circulation water and/or into the broke system D. This circulation water is passed, after various treatments (which are not shown), along a duct 6 to constitute jet water in the wire part 4 and in the press section 5.

Figure 2:
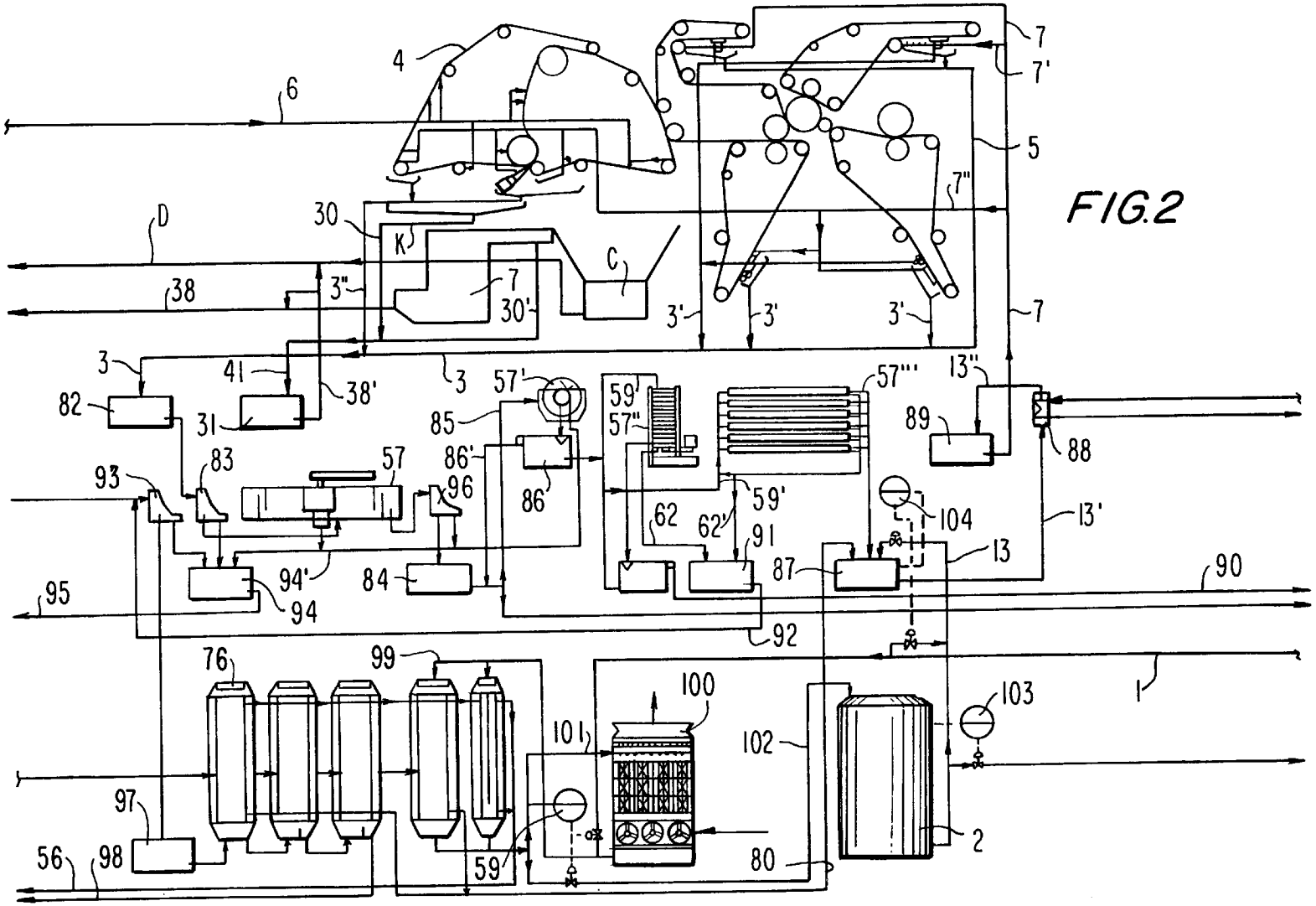
FIG. 2 shows a paper machine in accordance with the invention, which is an improvement over the paper machine shown in FIG. 1.

FIG. 2 shows an embodiment in accordance with the present invention as applied to an environment of the paper machine shown in FIG. 1. In FIG. 2, conditioning water flows or waters and circulation water flows or waters are collected from the press section 5 and passed along ducts 3,3' into a conditioning and wash water tank 82, and not into the circulation water tank 31, which is the case in FIG. 1. Also from the wire part 4, conditioning waters are collected along a duct 3" and passed through the conditioning and wash water tank 82 to a flotation cleaning system. In the flotation cleaning system, first a coarse cleaning takes place in screens 83, after which the water is cleaned in a flotator 57. The clean water is then passed through a screen 96 into a clarification tank 84 and further to microfiltration system 57' along a duct 85. After this, the clean water is passed through a microfiltration tank 86 to an ultra-membrane filter 57" along a duct 59 and/or to a nanomembrane filtration system 57'" along a duct 59' and from there into a clean-water tank 87. An overflow from the microfiltration tank 86 is passed to mix with the outlet waters of the clarification tank 84 along a duct 86'. Fresh water enters into the clean-water tank 87 along a duct 13 from the clean-water tank 2. Regulators 103,104 operate together so that the supply of water into the tank 87 in the paper machine is secured and maintained as desired. The excess amount of warm water is passed to other uses (not shown). Part of the fresh water is, however, also passed directly into the warm water tank 87 along the duct 1. Into the warm clean-water tank 87, water also arrives from an evaporator 76 along a duct 80. From the warm water tank 87, water is passed through a heat exchanger 88 into a hot water tank 89 along a duct 13' to constitute jet water for the press section 5 and for the wire part 4.

Part of the cleaned waters are passed from the microfiltrations and ultra-membrane filtrations stages etc., away along ducts 90 to constitute conditioning and wash waters and later along the duct 6 to the wire part and the press section. After the ultramembrane filtration, the concentrate passes along the duct 62, and after nanomembrane filtration along the duct 62', to a concentrate tank 91 and from there to mix with the process water flow along the duct 92. The process water passes through a fine screen 93, and after the fine screen 93 the reject passes into a sludge tank 94, from which the sludge passes further along a duct 95 to sludge treatment. To the sludge tank 94, the sludges are also collected from the flotator 57, from the fine screen 96 and from the microfiltration 57' along the duct 94'. From the fine screen 93, the filtrate is passed through a feed tank 97 to the evaporator 76. The concentrates from the evaporator or evaporators are passed away along a duct 98. The clean condensate is passed along a duct 80 into the warm water tank 87. The vapor from the evaporator passes to a condenser 99, to which cooling water arrives from the cooling tower 100, and the temperature of the cooling water is regulated by means of a regulation device 59. The water that has become warm in the condenser is passed to the top portion of the cooling tower 100 along a duct 101. It is one embodiment of the invention that, after the cooling tower 100, fresh water is passed to the warm-water tank 2 for fresh water along a duct 102 through the condenser 99.

Figure 3:
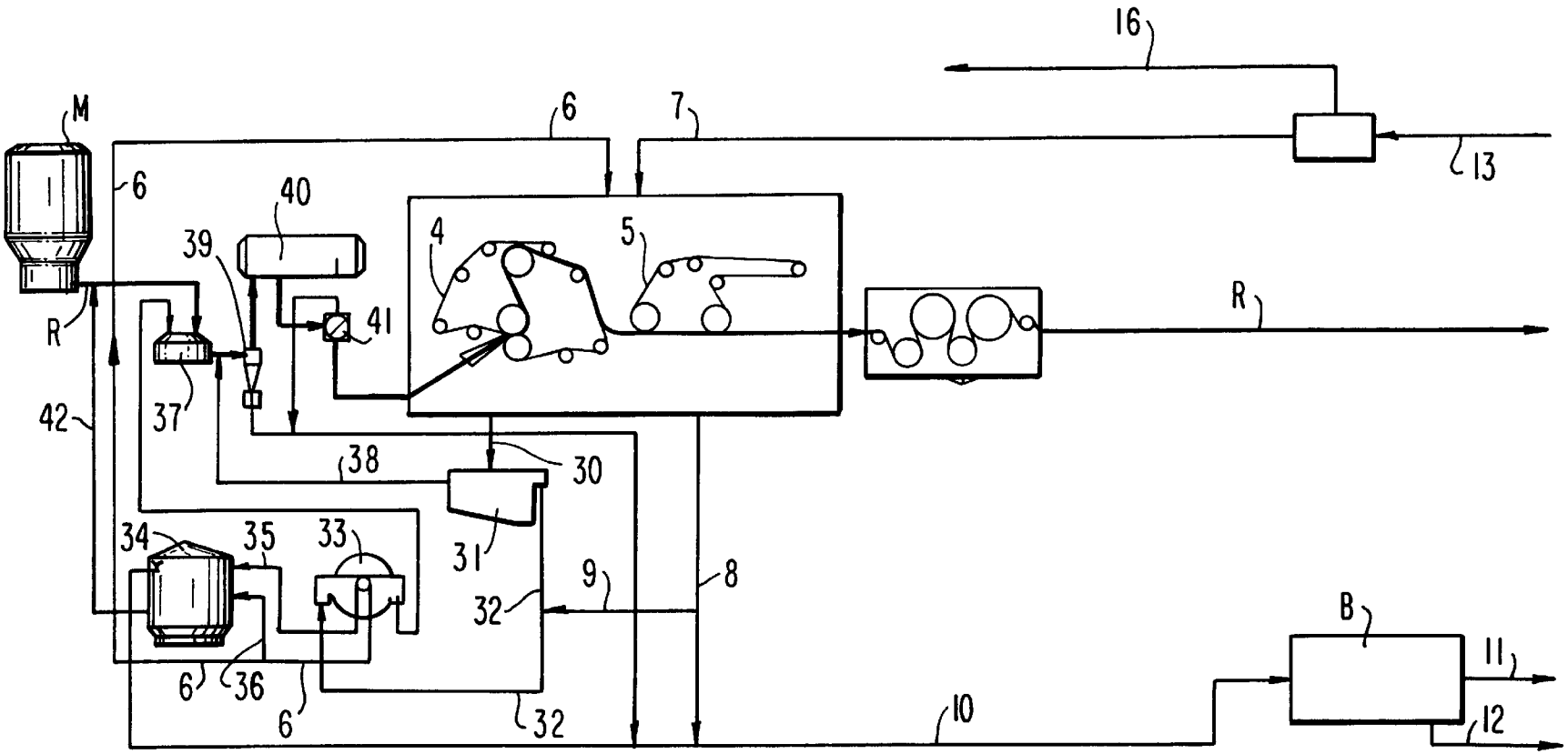
FIG. 3 shows a second prior art paper machine.

FIG. 3 shows a second prior art paper machine. In FIG. 3, corresponding parts are denoted by the same reference numerals as in the paper machine shown in FIG. 1.

In the paper machine shown in FIG. 3, the raw material comes from a stock tank M first to the wire part 4 and after that to the press section 5 for dewatering. In the wire part 4 and in the press section 5, the wires and the machine parts are cleaned by means of water jets, to which water is passed along the ducts 6,7.

In this prior art paper mill, the conditioning and wash water flows or waters are passed into a common wire pit along the duct 8, and from there a. smaller proportion to the sewer for further processing, for example biological purification B, along the duct 10.

Mainly, these conditioning waters have been combined with the circulation waters, which is shown to take place along the duct 9 in FIG. 1. From the tank 34, the waste waters are passed along the duct 10 to treatment, e.g., biological treatment B, and further away along a duct 11, and the sludge is passed along a duct 12.

Fresh water is passed to the paper machine along a duct 13 to constitute jet water for the wire part and for the press section along the duct 7. Further, the supply of fresh water is also shown for other needs besides for the wet end of the paper machine, for example for dilution of chemicals etc., to which uses fresh water is passed in this embodiment along a duct 16.

The circulation waters of the wire part enter along the duct 30 into the tank 31 and are passed along a duct 32 to a disk filter 33, and from there the filtrates pass into a tank 34 along ducts 35 and 36. The cleanest filtrate from the disk filter 33 is used as jet water in the wire part 4, to which it is passed along the duct 6. From the wire pit or tank 31, dilution water is taken into the stock after a mixing tank 37 along a duct 38, and a filtrate from the disk filter 33 is also passed to the mixing tank. The raw material runs through processing stages 37,39,40,41 (e.g., stock dilution, screening, rotary cleaning, removal of gases) before the raw material enters into the wire part 4. From the tank 34, part of the waters is passed along a duct 42 as dilution water for the stock arriving from the stock preparation plant.

Generally speaking, depending on the particular paper mill, the fabric conditioning waters from a paper machine are, in the prior art, either passed back into the circulation water system or passed into the sewer. If the fresh-water jets in a paper machine are not sufficient to keep the water circulations in the machine clean enough, additional fresh water can usually be supplied directly into the short cycle in the paper machine.

Figure 4:
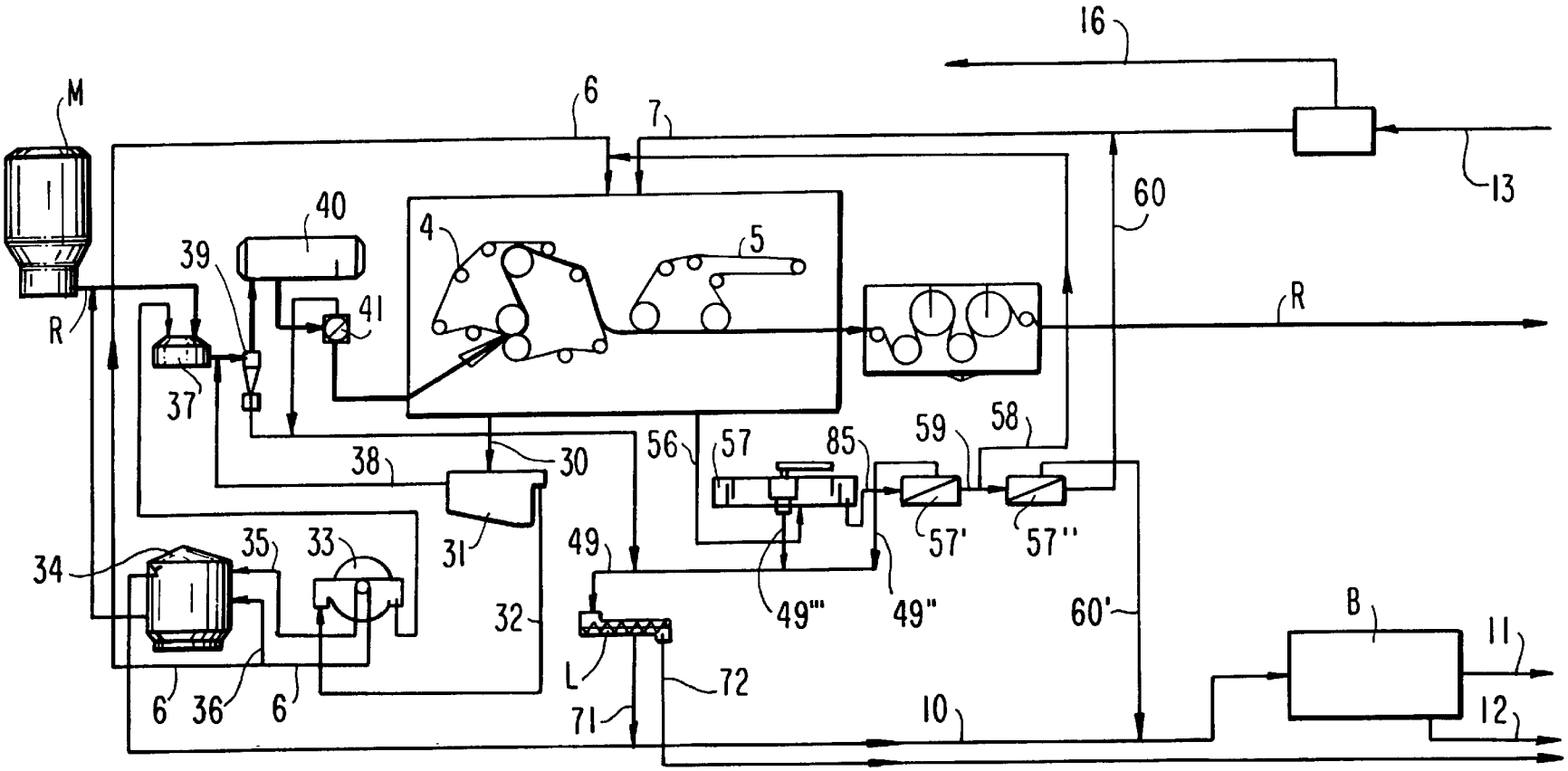
FIG. 4 shows a paper machine in accordance with the invention, which is an improvement over the paper machine shown in FIG. 3.

FIG. 4 shows an embodiment of the invention as applied to the prior art environment of a paper machine shown in FIG. 3. In the embodiment shown in FIG. 4, the waters used for conditioning of the fabrics are passed along a duct 56 for cleaning to the flotator 57, after which the water is cleaned further by means of microfiltration system 57, to which it is passed along a duct 85, in which cleaning stages suspended solids and colloidal agents are removed from these waters, and a part of the waters thus cleaned is passed as jet waters for the paper machine along the duct 58, which duct is connected to the duct 6, along which circulation waters are passed to the jets in the wire part 4. After the microfiltration, water can be favorably cleaned further by means of ultra-filtration and/or nanofiltration systems 57", to which it is passed along a duct 59. The clean fraction from the ultra-filtration and/or nanofiltration is passed along a duct 60 to substitute for fresh water, and the concentrate is passed to the waste waters along a duct 62 and from there further, for example, to biological purification and treatment B. The duct 62 communicates with the duct 10. The rejects from the cleaning stages 57,57' are passed along ducts 49" and 49'", which communicate with a duct 49 passing to a sludge press L. From the sludge press, the waste water and sludge may be passed either to the biological treatment B, along duct 71 leading into duct 10, or directly to the waste stream.

Figure 5:
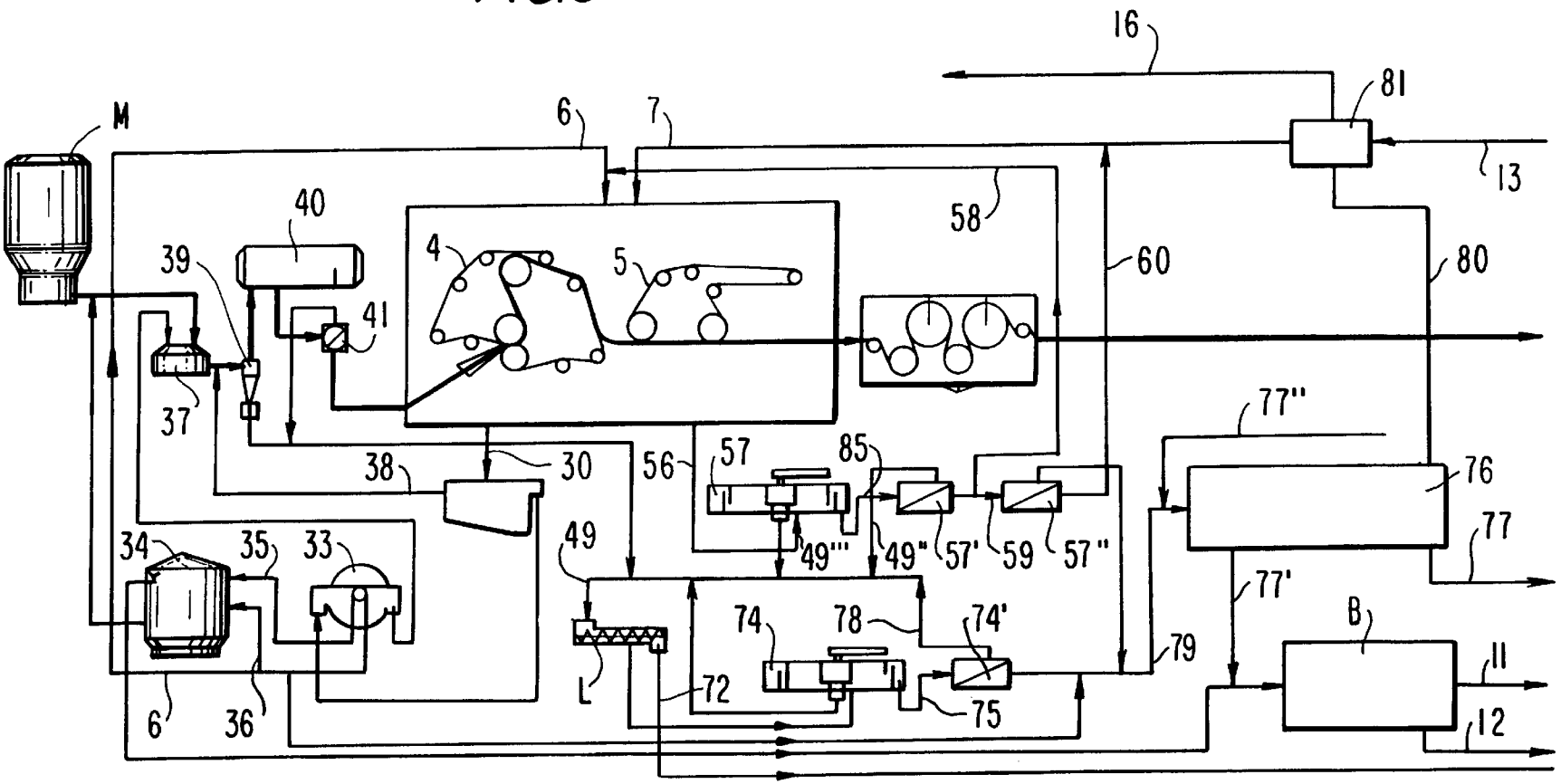
FIG. 5 shows a preferred embodiment of the invention related to the paper machine shown in FIG. 4.

FIG. 5 shows an embodiment in which the sludges from the cleaning stages 57,57' and 57" and the rejects coming from the short circulation are passed into the sludge press L, from which the sludge is passed to the sludge treatment, and the filtrate is cleaned further by means of a second flotator 74 and by means of a subsequent microfiltration system 74', to which it is passed along a duct 75. The sludge from the flotation and from the microfiltration system 74' is passed again into the sludge press L along a duct 78 and along the duct 49, and the filtrate is passed to evaporation unit 76 along duct 79.

A substantial proportion of the fresh water passed to the paper machine is substituted for by the cleaned water obtained from the evaporation device 76, and this cleaned water is passed along a duct 80 to a fresh-water tank 81. Clean water obtained from the evaporation plant 76 is also passed to other use along the duct 16. The concentrate of the evaporation device or evaporator 76 is passed along a duct 77 away, and the contaminated condensate is passed along a duct 77' further to cleaning. In FIG. 5, the duct 77" is also shown, along which any other process waters whatsoever can also be passed to the evaporator. A portion of the cleanest filtrate from the disk filter 33 may also be passed to the duct 79 leading into the evaporator unit 76.

Figure 6:
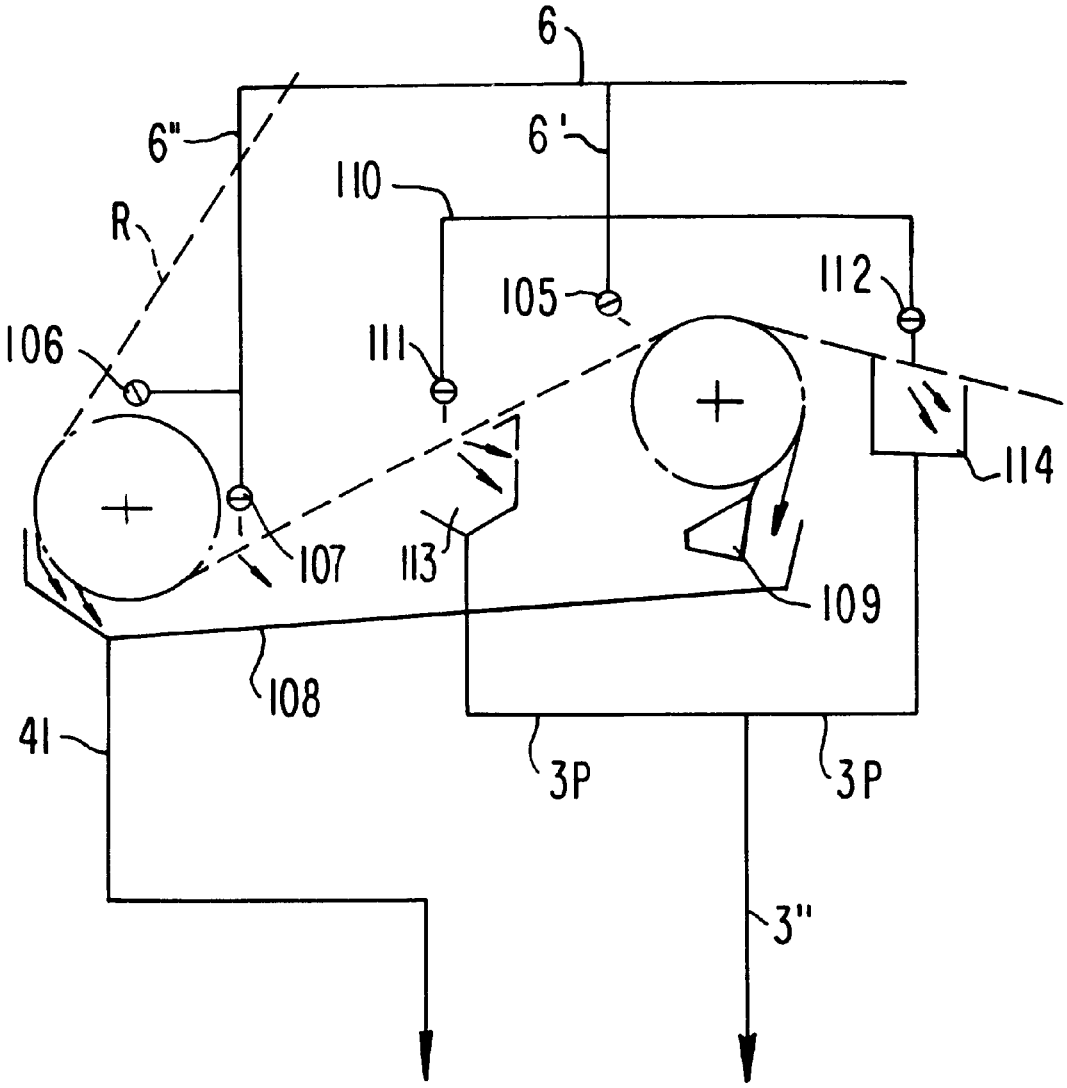
FIG. 6 is a more detailed illustration of selective collecting of the waters from the wire part.

FIG. 6 is a detailed illustration of selective collecting of the wash waters from the wire part 4. Circulation water which has been cleaned arrives as jet water in the wire part along the duct 6, which is branched into the ducts 6' and 6". Along the duct 6', the circulation water passes into a jet pipe 105 to constitute wire conditioning and wash water. Along the duct 16", the circulation water passes preferably into another two jet pipes 106 and 107 to constitute wash and conditioning water. The paper web formed in the paper machine is denoted by reference R. After washing and conditioning, the waters are collected in a trough 108. FIG. 6 also shows a doctor 109 operative against roll, and the wash water used for its lubrication drains into the trough 108. Fresh water is also passed as conditioning water along a duct 110 and further into a jet pipe 111 and a jet pipe 112, in which it is used for wash and conditioning requirements. The wash waters coming from the fresh water jets are collected by means of water collecting equipment 113 and 114 situated in opposed relationship to the jet pipes 111,112, respectively, and passed through ducts 3P into a duct 3" into a wash water tank. The wash waters coming from the circulation water jets pass from trough 108 along the duct 41 into the circulation water tank (not shown). Thus, FIG. 6 is a detailed illustration of the collecting of waters in the wire parts in FIGS. 2, 4 and 5.

Figure 7:
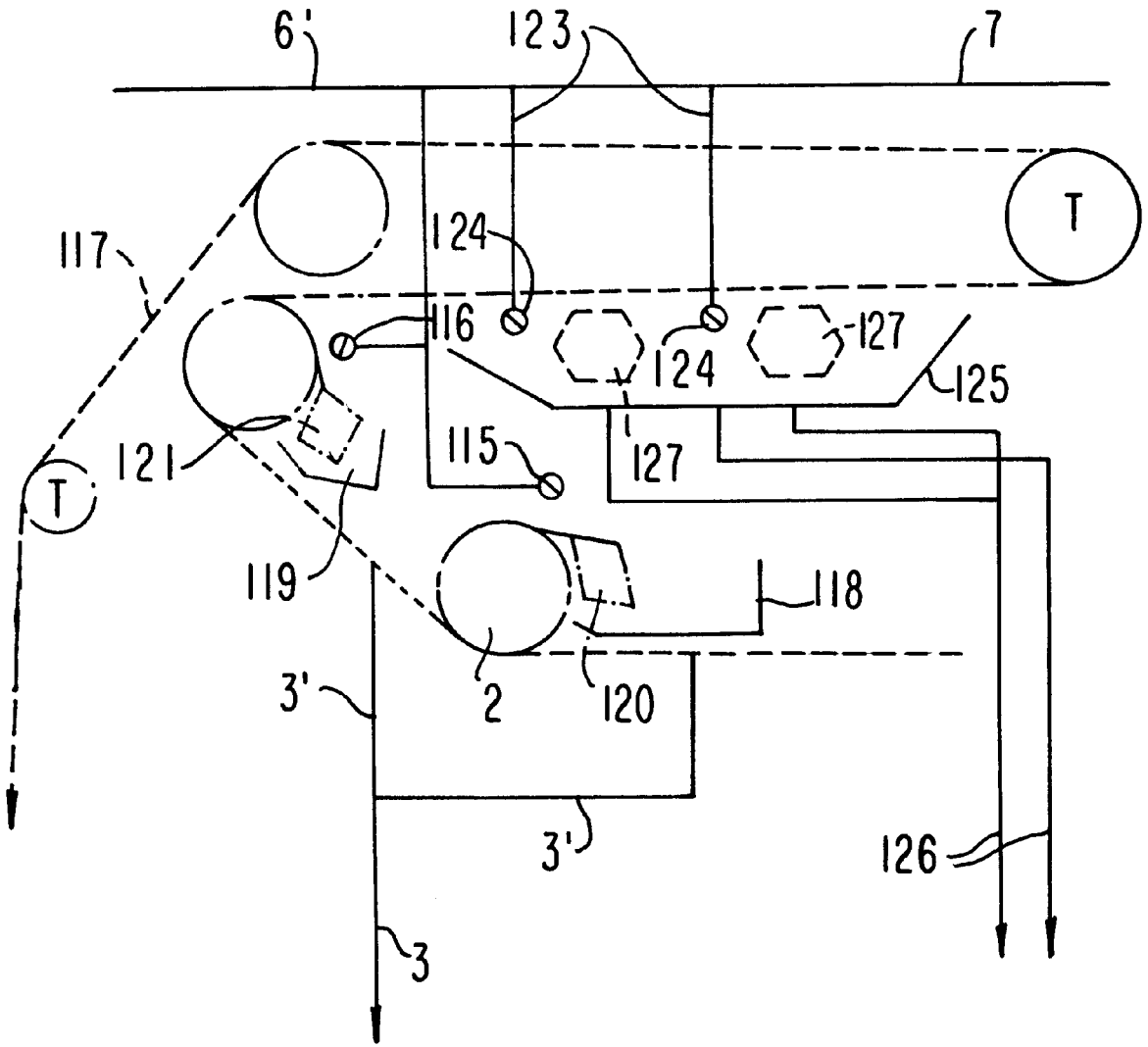
FIG. 7 is a more detailed illustration of selective collecting of the waters from the press section.

FIG. 7 illustrates selective collecting of the press waters in accordance with the invention. Circulation water flows along the duct 6' into jet pipes 115 and 116 in the press section. The press felt is denoted by reference numeral 117. The conditioning waters coming from circulation water jets are collected by means of troughs 118 and 119 associated with doctors 120 and 121, respectively, and further passed along the ducts 3' and the duct 3 into the circulation water tank. Fresh water is also used in the press section as conditioning water, which is passed along the duct 7. The water passes along a ducts 123 into jet pipes 124 and is collected by means of a trough 125 and passed further into the wash water tank along ducts 126. FIG. 7 also shows felt conditioning devices 127 for conditioning the press felt. Thus, FIG. 7 is a detailed illustration of the collecting of wash waters in the press section in FIGS. 2, 4 and 5.

In the following, the patent claims will be given, and the various details of the invention can show variation within the scope of the inventive idea defined in the claims and differ even to a considerable extent from the details stated above by way of example only. As such, the examples provided above are not meant to be exclusive and many other variations of the present invention would be obvious to those skilled in the art, and are contemplated to be within the scope of the appended claims.

We claim:

1. A method for circulating and cleaning water in a paper machine, comprising the steps of:

recovering wash water from fabrics and other devices in the paper machine and water drained from a paper web to be produced in the paper machine in a plurality of distinct and separate water flows, each one of said plurality of distinct and separate water flows originating at a different location in the paper machine and having a corresponding water quality dependent on said different location in said paper machine, cleaning at least some of said plurality of distinct and separate water flows to produce a plurality of cleaned water flows, and recirculating said cleaned water flows to a selected application of reuse in the paper machine based on said water quality.

2. The method of claim 1, wherein the step of recovering wash water in a plurality of distinct and separate water flows comprises the steps of collecting a flow of circulation water drained from the paper web, a flow of water used for conditioning the fabrics, a flow of water used for washing devices in the paper machine, a flow of water used for lubricating components in the paper machine, and a flow of water used for sealing components in the paper machine, further comprising the steps of:

passing the circulation water flow drained from the paper web to a short cycle of the paper machine to be recirculated as part of a fibrous mixture from which a web is formed in the paper machine, said cleaning step comprises the steps of directing the fabric conditioning water flow and the washing device flow into at least one of a flotation cleaning stage and a microfiltration cleaning stage and separating suspended solid matter and colloids from the fabric condition and washing device water flows in the flotation cleaning state and microfiltration stage.

3. The method of claim 2, wherein the paper machine includes a first set of water jets which operate on circulation water and a second set of water jets which operate on water cleaner than the circulation water, wherein the step of recirculating the recovered cleaned water comprises the steps of:

directing a first part of the plurality of cleaned water flows from the at least one of the flotation stage and the microfiltration stage to the first set of water jets, directing a second part of the plurality of cleaned water flows from the at least one of the flotation stage and the microfiltration stage through a membrane separation stage for further cleaning, and directing at least a portion of said second part cleaned by the membrane separation stage to the second set of water jets.

4. The method of claim 3, wherein a concentrate is produced during the membrane separation stage, further comprising the steps of:

passing the concentrate produced during the membrane separation stage into an evaporator in which clean water as a substitute for fresh water is generated from the concentrate, and passing the clean water obtained from the evaporator to the second set of water jets.

5. The method of claim 3, wherein a concentrate is produced during the membrane separation stage, further comprising the steps of:

passing the concentrate produced during the membrane separation stage to mix with a waste water flow.

6. The method of claim 2, further comprising the step of cleaning the circulation water flow drained from the web in the short cycle of the paper machine.

7. The method of claim 2, wherein a screen used in the microfiltration cleaning stage is in a range of from about $10\mu$ to about $50\mu$.

8. The method of claim 2, further comprising the steps of:

directing fresh water for eventual use in the paper machine into a condenser, the fresh water being warmed in the condenser, directing the warm fresh water from the condenser into a warm-water tank, passing filtrate generated during the flotation and microfiltration cleaning stages into an evaporator in which clean water as a substitute for fresh water is generated from the filtrate, passing the clean water from the evaporator into the warm-water tank, and passing the warm water from the warm-water tank to the paper machine for use as fresh water in the paper machine.

9. The method of claim 1, wherein said cleaning step comprises the steps of:

directing the at least some of the plurality of distinct and separate water flows into a flotation cleaning stage and a microfiltration cleaning stage, separating suspended solid matter and colloids from the water flows in the flotation and microfiltration cleaning stages to clean the water flows, passing sludge generated in the flotation and microfiltration cleaning stages into a sludge press, and cleaning filtrate generated by the sludge press by directing the filtrate into and through an additional flotation cleaning stage and an additional microfiltration cleaning stage.

10. The method of claim 9, further comprising the steps of:

passing filtrate generated during the microfiltration cleaning stage into an evaporator in which clean water as a substitute for fresh water is generated from the filtrate, passing the clean water obtained from the evaporator to specific water jets in the paper machine, and passing sludge from the evaporator into the sludge press.

11. The method of claim 1, further comprising the steps of:

directing fresh water for eventual use in the paper machine into a condenser, the fresh water being warmed in the condenser, directing the warm fresh water from the condenser into a warm-water tank, and passing the warm water from the warm-water tank to the paper machine for use as fresh water in the paper machine.

12. The method of claim 11, further comprising the step of minimizing an amount of water passing from the warm water tank into a sewer by means of regulation devices so that the quantities of fresh water passed into in the paper machine become smaller.

13. The method of claim 1, wherein said plurality of distinct and separate water flows comprise wash water flows collected from the wire parts by means of individual troughs.

14. The method of claim 1, wherein the step of recovering water flows comprises the steps of collecting water used for conditioning the fabrics and water used for washing devices in the paper machines separately by means of individual troughs, further comprising the step of:

passing the collected conditioning and wash water flows into a wash water tank, said cleaning step comprises the steps of directing the fabric conditioning water flows and the washing device flows from the wash water tank into a flotation cleaning stage and a microfiltration cleaning stage and separating suspended solid matter and colloids from the water flows in the flotation cleaning stage and microfiltration cleaning stage to clean the water flows, and directing the cleaned fabric conditioning water flows and washing device flows to water jets in the wire part.

15. The method of claim 14, wherein said cleaning step further comprises the steps of directing the fabric conditioning water flows and the washing device flows from the flotation and microfiltration cleaning stages through a membrane separation stage for further cleaning, and directing at least a part of the products from the membrane separation stage to the water jets in the wire part.

16. The method of claim 1, wherein the recovering step comprises the step of collecting water flows used for conditioning the fabrics in the paper machine and water used in washing devices in the paper machine in a first set of troughs and collecting water drained from the web in a second set of troughs separate from said first set of troughs, the water drained from the web being cleaned, the recirculating step comprises the step of using the cleaned water drained from the web as water for conditioning the web and the washing devices.

17. The method of claim 1, wherein the recovering step comprises the step of collecting water flows used in water jets in the paper machine in a first set of troughs and collecting water used for conditioning the fabrics in the paper machine in a second set of troughs separate from said first set of troughs, the collected fabric conditioning water being cleaned, and the recirculating step comprises the step of using the cleaned fabric conditioning water as water for the water jets.

* * * * *